US009192010B2

(12) United States Patent
Seo et al.

(10) Patent No.: US 9,192,010 B2
(45) Date of Patent: Nov. 17, 2015

(54) DIMMING CONTROL APPARATUS, LIGHT SYSTEM DRIVING APPARATUS AND DIMMING CONTROL METHOD

(71) Applicant: SAMSUNG ELECTRO-MECHANICS CO., LTD., Suwon, Gyunggi-do (KR)

(72) Inventors: Kyu Tae Seo, Gyunggi-do (KR); Ki Hong Kim, Gyunggi-do (KR); Dae Hoon Choi, Gyunggi-do (KR); Min Jin Kim, Gyunggi-do (KR); Heung Gyoon Choi, Gyunggi-do (KR); Byoung Woo Ryu, Gyunggi-do (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 282 days.

(21) Appl. No.: 13/954,330

(22) Filed: Jul. 30, 2013

(65) Prior Publication Data

US 2014/0176001 A1 Jun. 26, 2014

(30) Foreign Application Priority Data

Dec. 21, 2012 (KR) ..... 10-2012-0151452

(51) Int. Cl.
*H05B 37/02* (2006.01)
*H05B 39/04* (2006.01)
*H05B 33/08* (2006.01)

(52) U.S. Cl.
CPC ..... *H05B 33/0845* (2013.01)

(58) Field of Classification Search
CPC . H05B 33/08; H05B 33/0833; H05B 33/0842
USPC ..... 315/307, 312
See application file for complete search history.

(56) References Cited

U.S. PATENT DOCUMENTS 6,329,767 B1 * 12/2001 Sievers ..... 315/307
6,380,692 B1 * 4/2002 Newman et al. ..... 315/194

(Continued)

FOREIGN PATENT DOCUMENTS

KR 10-2010-0012284 A 2/2010
KR 10-2010-0037679 A 4/2010

(Continued)

OTHER PUBLICATIONS

Korean Office Action issued in Korean Application No. 10-2012-0151452 dated Apr. 22, 2014, w/English translation.

*Primary Examiner* — Kenneth B Wells
(74) *Attorney, Agent, or Firm* — McDermott Will & Emery LLP

(57) ABSTRACT

There are provided a dimming control apparatus, a lighting system driving apparatus, and a dimming control method, the dimming control apparatus including a voltage converting unit converting a dimming signal from a dimmer into dimming voltage, an analog-to-digital (A/D) converting unit converting the dimming voltage into a digital dimming value, a dimming setting unit determining whether or not the digital dimming value is included in a preset dimming value range, and when the digital dimming value is not included in the preset dimming value range, resetting the dimming value range so as to allow the digital dimming value to be included in the reset dimming value range, a memory unit storing a dimming control value corresponding to the digital dimming value, and a dimming control unit generating a dimming control signal based on the dimming control value corresponding to the digital dimming value from the A/D converting unit.

11 Claims, 6 Drawing Sheets

(56) References Cited

U.S. PATENT DOCUMENTS

| | | | | |
|---|---|---|---|---|
| 6,980,122 | B2 * | 12/2005 | Novikov | 340/12.32 |
| 7,012,518 | B2 * | 3/2006 | Novikov | 340/538 |
| 8,581,521 | B2 * | 11/2013 | Welten et al. | 315/312 |
| 8,618,751 | B2 * | 12/2013 | Ostrovsky et al. | 315/362 |
| 8,823,286 | B2 * | 9/2014 | Sasai et al. | 315/307 |
| 8,872,437 | B2 * | 10/2014 | Esaki et al. | 315/224 |
| 8,892,913 | B2 * | 11/2014 | Newman et al. | 713/300 |
| 8,988,010 | B2 * | 3/2015 | Suzuki | 315/307 |
| 2010/0020108 | A1 | 1/2010 | Cho et al. | |
| 2011/0050110 | A1 | 3/2011 | Han | |

FOREIGN PATENT DOCUMENTS

| | | | |
|---|---|---|---|
| KR | 10-2011-0024102 | A | 3/2011 |
| KR | 10-2011-0041147 | A | 4/2011 |
| KR | 10-2012-0061330 | A | 6/2012 |

* cited by examiner

DIMMING CONTROL APPARATUS, LIGHT SYSTEM DRIVING APPARATUS AND DIMMING CONTROL METHOD

CROSS-REFERENCE TO RELATED APPLICATIONS

This application claims the priority of Korean Patent Application No. 10-2012-0151452 filed on Dec. 21, 2012, in the Korean Intellectual Property Office, the disclosure of which is incorporated herein by reference.

BACKGROUND OF THE INVENTION

1. Field of the Invention

The present invention relates to a dimming control apparatus, a lighting system driving apparatus, and a dimming control method able to be applied to a system using a light-emitting diode (LED).

2. Description of the Related Art

In general, incandescent light bulbs, a fluorescent lights, or the like, may be used in a lighting system. Recently, light emitting diodes (LEDs) have been substituted for incandescent light bulbs, fluorescent lights, or the like, due to advantages thereof such as low levels of power consumption, a long effective lifespan, and the like.

In accordance with the expansion of the market for LED lighting systems, the available types of LEDs have been increased. Therefore, types of dimming scheme and dimmers corresponding to technology for adjusting the brightness of lighting systems have also been diversified.

A control method is changed according to the type of dimmer provided in an LED lighting system, and an output needs to be controlled according to the provided dimmer.

Meanwhile, examples of dimmers used in analog lighting schemes include a sink dimmer and a source dimmer. Particularly, in a case of the sink dimmer, the sink dimmer has different variable ranges according to the kind thereof and dimming signals are thus different from each other.

Therefore, not all dimmers are compatible with a single LED lighting system, some dimmers may be compatible with one LED lighting system, while other dimmers are compatible with other LED lighting systems.

In lighting systems according to the related art, dimmers may use various dimming schemes such as source dimmers and sink dimmers, as described above, and sink dimmers may have various characteristics according to the manufacturer thereof, such that limitations exist in using appropriate dimmers.

Particularly, in the case in which a lighting system is already installed, it is difficult to change or substitute a dimmer and the applicability of a dimmer desired to be applied to a driving device of a lighting system needs to be checked with a test process every time.

Patent Document 1, the following related art document, relates to a lamp driving apparatus having an expanded dimming range, but does not disclose a technical feature allowing a range of dimming values to be reset, so as to correspond to various dimmers having different characteristics.

RELATED ART DOCUMENT (Patent Document 1) Korean Patent Laid-Open Publication No. 2011-0041147

SUMMARY OF THE INVENTION

An aspect of the present invention provides a dimming control apparatus, a lighting system driving apparatus, and a dimming control method capable of resetting a range of dimming values so as to correspond to various dimmers having different characteristics.

According to an aspect of the present invention, there is provided a dimming control apparatus, including: a voltage converting unit converting a dimming signal from a dimmer into dimming voltage; an analog-to-digital (A/D) converting unit converting the dimming voltage into a digital dimming value; a dimming setting unit determining whether or not the digital dimming value is included in a preset dimming value range, and when the digital dimming value is not included in the preset dimming value range, resetting the dimming value range so as to allow the digital dimming value to be included in the reset dimming value range; a memory unit storing a dimming control value corresponding to the digital dimming value; and a dimming control unit generating a dimming control signal based on the dimming control value corresponding to the digital dimming value from the A/D converting unit.

According to another aspect of the present invention, there is provided a lighting system driving apparatus, including: a voltage converting unit converting a dimming signal from a dimmer into dimming voltage; an analog-to-digital (A/D) converting unit converting the dimming voltage into a digital dimming value; a dimming setting unit determining whether or not the digital dimming value is included in a preset dimming value range, and when the digital dimming value is not included in the preset dimming value range, resetting the dimming value range so as to allow the digital dimming value to be included in the reset dimming value range; a memory unit storing a dimming control value corresponding to the digital dimming value; a dimming control unit generating a dimming control signal based on the dimming control value corresponding to the digital dimming value from the A/D converting unit; and a driving unit generating a lighting system driving signal according to the dimming control signal.

The dimming setting unit may determine whether or not the digital dimming value is higher than a maximum value of the dimming value range, and when the digital dimming value is higher than the maximum value of the dimming value range, may change the maximum value and may store the changed maximum value.

The dimming setting unit may determine whether or not the digital dimming value is lower than a minimum value of the dimming value range, and when the digital dimming value is lower than the minimum value of the dimming value range, may change the minimum value and may store the changed minimum value.

The driving unit may generate the lighting system driving signal using a pulse width modulation scheme in order to drive an LED light emitting unit according to the dimming control signal.

According to another aspect of the present invention, there is provided a dimming control method performed in a dimming control apparatus, the dimming control method including: converting a dimming signal from a dimmer into dimming voltage; converting the dimming voltage into a digital dimming value; determining whether or not the digital dimming value is included in a preset dimming value range; resetting the dimming value range so as to allow the digital dimming value to be included in the reset dimming value range when the digital dimming value is not included in the preset dimming value range, and storing a dimming control value corresponding to the digital dimming value; and generating a dimming control signal based on the dimming control value corresponding to the digital dimming value.

In the determining of whether or not the digital dimming value is included in the preset dimming value range, it may be determined whether or not the digital dimming value is higher than a maximum value of the dimming value range, and when the digital dimming value is not higher than the maximum value of the dimming value range, it may be determined whether or not the digital dimming value is lower than a minimum value of the dimming value range.

In the resetting of the dimming value range, when the digital dimming value is higher than the maximum value of the dimming value range, the maximum value may be changed and stored.

In the resetting of the dimming value range, when the digital dimming value is lower than the minimum value of the dimming value range, the minimum value may be changed and stored.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
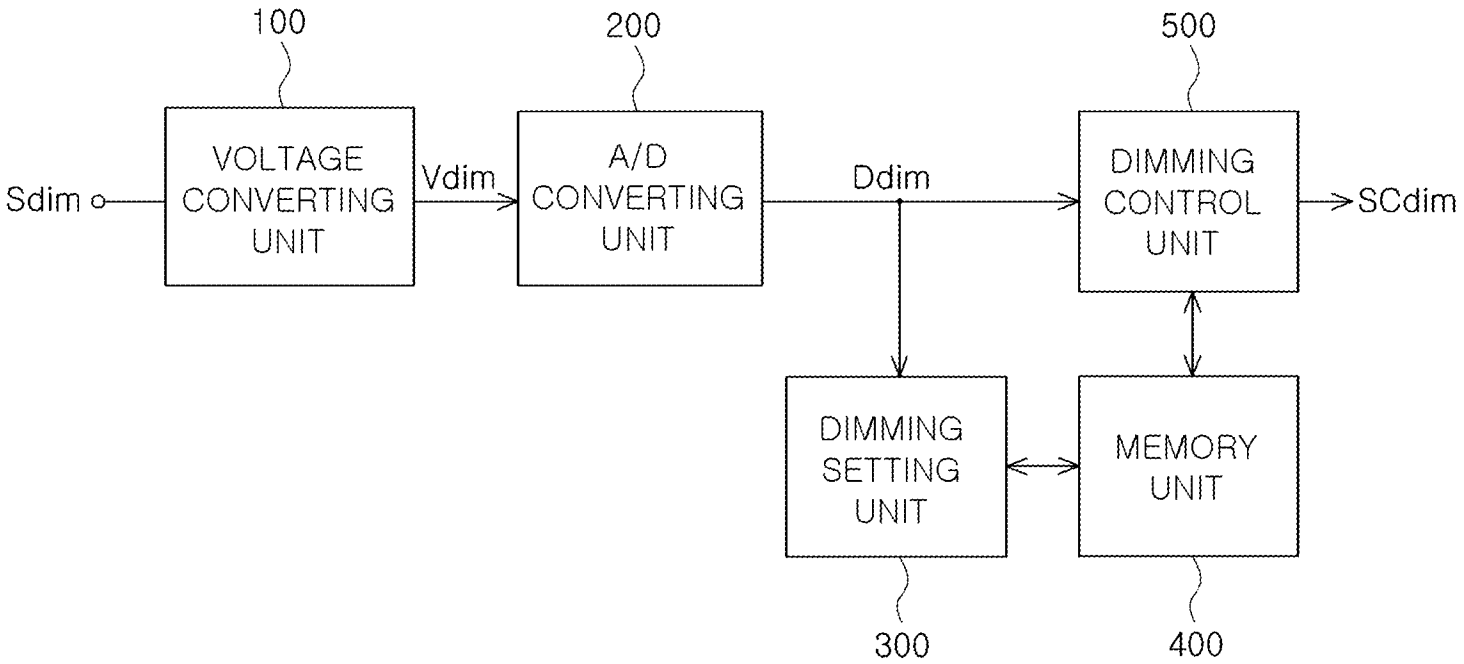
FIG. 1 is a configuration diagram showing a dimming control apparatus according to an embodiment of the present invention.

Hereinafter, embodiments of the present invention will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like elements.

FIG. 1 is a configuration diagram showing a dimming control apparatus according to an embodiment of the present invention.

Referring to FIG. 1, the dimming control apparatus according to the embodiment of the present invention may include a voltage converting unit 100, an analog-to-digital (A/D) converting unit 200, a dimming setting unit 300, a memory unit 400, and a dimming control unit 500.

Figure 2:
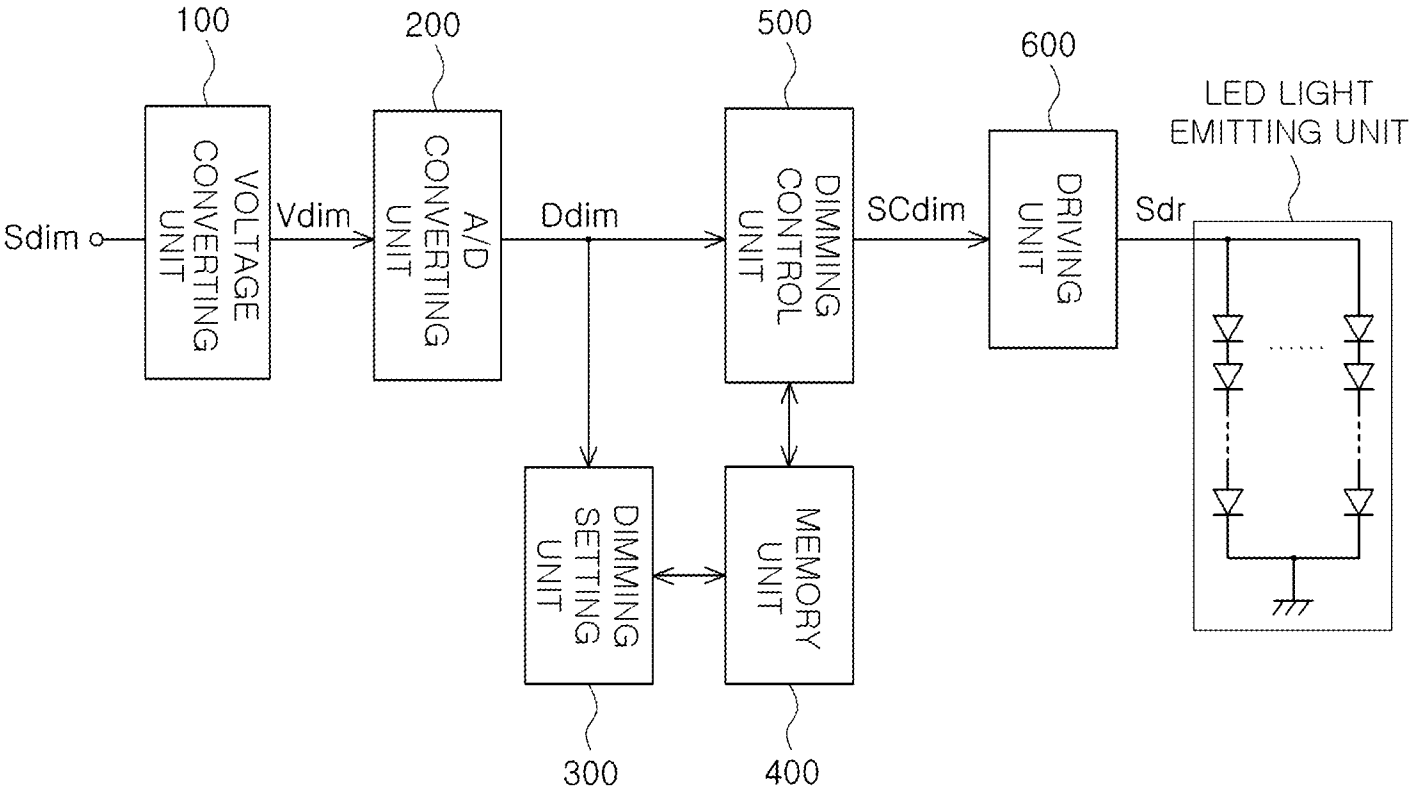
FIG. 2 is a configuration diagram showing a lighting system driving apparatus according to an embodiment of the present invention.

FIG. 2 is a configuration diagram showing a lighting system driving apparatus according to an embodiment of the present invention.

Referring to FIG. 2, the lighting system driving apparatus according to the embodiment of the present invention may include the voltage converting unit 100, the A/D converting unit 200, the dimming setting unit 300, the memory unit 400, the dimming control unit 500, and a driving unit 600.

Referring to FIGS. 1 and 2, the voltage converting unit 100 may convert a dimming signal Sdim from a dimmer into dimming voltage Vdim to provide the dimming voltage Vdim to the A/D converting unit 200. In this case, the dimmer may be provided in plural and the plurality of dimmers may provide different signals. Here, the dimming signal may be voltage or impedance provided by the dimmer.

The A/D converting unit 200 may convert the dimming voltage Vdim from the voltage converting unit 100 into a digital dimming value Ddim to provide the digital dimming value Ddim to the dimming setting unit 300 and the dimming control unit 500.

The dimming setting unit 300 may determine whether or not the digital dimming value Ddim is included in a preset dimming value range, and when the digital dimming value Ddim is not included therein, may reset the dimming value range so as to allow the digital dimming value Ddim to be included in the reset dimming value range.

First, the dimming setting unit 300 may determine whether or not the digital dimming value Ddim is higher than a maximum value of the dimming value range, and when it is higher than the maximum value of the dimming value range, may change the maximum value and store the changed maximum value.

As an example, a new maximum value max' formed by changing an existing maximum value max may be obtained as in the following Equation 1.

$$\text{digital dimming value max}' = \text{digital dimming value}(Ddim) \quad \text{[Equation 1]}$$

$$\text{dimming contol value max}' = \text{dimming contol value max} * \left( \frac{\text{digital dimming value}_{\text{max}'}}{\text{digital dimming value}_{\text{max}}} \right)$$

Next, the dimming setting unit 300 may determine whether or not the digital dimming value Ddim is lower than a minimum value of the dimming value range, and when it is lower than the minimum value of the dimming value range, may change the minimum value and store the changed minimum value.

As an example, a new minimum value min' formed by changing an existing minimum value min may be obtained as in the following Equation 2.

$$\text{digital dimming value min}' = \text{digital dimming value}(Ddim) \quad \text{[Equation 2]}$$

$$\text{dimming contol value min}' = \text{dimming contol value min} * \left( \frac{\text{digital dimming value}_{\text{min}'}}{\text{digital dimming value}_{\text{min}}} \right)$$

The above-provided Equation 1 and Equation 2 are used in the respective embodiments of the present invention, but a method of obtaining new minimum and maximum values is not limited using Equation 1 and Equation 2.

The memory unit 400 may store a dimming control value corresponding to the digital dimming value Ddim.

For example, the memory unit 400 may include a range of digital dimming values, wherein the range of digital dimming values includes a minimum value and a maximum value.

In addition, the memory unit 400 may include dimming control values corresponding to respective digital dimming values included in the range of the digital dimming values.

Further, the memory unit 400 may store the new digital dimming value Ddim reset by the dimming setting unit 300 and a new dimming control value corresponding thereto.

The dimming control unit 500 may generate a dimming control signal SCdim based on the dimming control value corresponding to the digital dimming value Ddim from the A/D converting unit 200.

In addition, the driving unit 600 may generate a lighting system driving signal according to the dimming control signal SCdim to provide the lighting system driving signal to an LED light emitting unit.

As an example, the driving unit 600 may generate a lighting system driving signal using a pulse width modulation scheme in order to drive the LED light emitting unit according to the dimming control signal.

Figure 3:
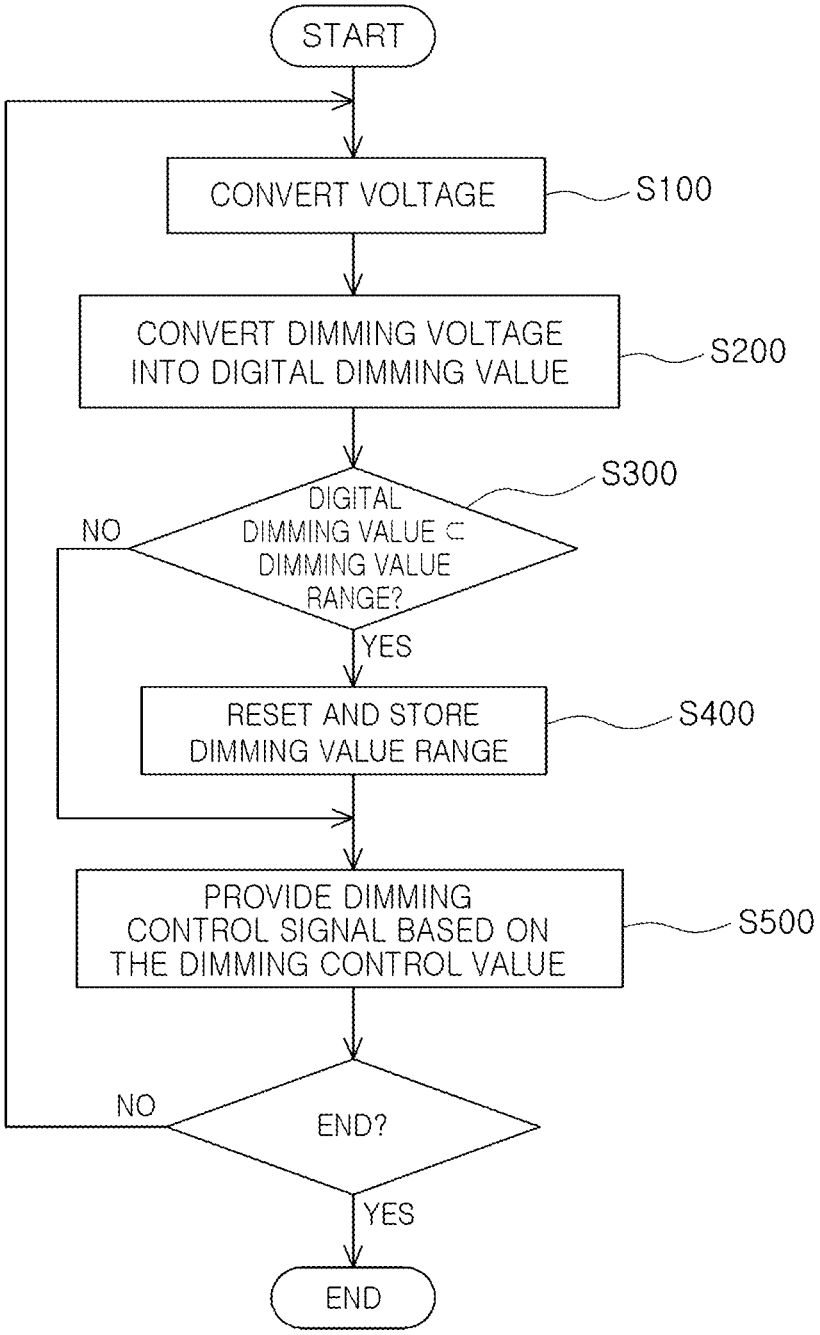
FIG. 3 is a flowchart showing a dimming control method according to an embodiment of the present invention.

FIG. 3 is a flowchart showing a dimming control method according to an embodiment of the present invention.

The dimming control method performed in the dimming control apparatus according to the embodiment of the present invention will be described with reference to FIGS. 1 through 3.

First, in operation S100, the voltage converting unit 100 may convert the dimming signal Sdim from the dimmer into the dimming voltage Vdim.

In operation S200, the A/D converting unit 200 may convert the dimming voltage Vdim into the digital dimming value Ddim.

Next, in operation S300, the dimming setting unit 300 may determine whether or not the digital dimming value Ddim is included in the preset dimming value range.

Next, in operation S400, the dimming setting unit 300 may reset the dimming value range so as to allow the digital dimming value Ddim to be included in the reset dimming value range when the digital dimming value Ddim is not included in the preset dimming value range, and may store the dimming control value corresponding to the digital dimming value Ddim in the memory unit 400.

In addition, in operation S500, the dimming control unit 500 may generate the dimming control signal SCdim based on the dimming control value corresponding to the digital dimming value Ddim.

Meanwhile, in operation S500, it is determined whether or not the dimming control method according to the embodiment of the present invention is terminated, and the dimming control method proceeds to operation S100 in the case in which termination is not selected and the dimming control method according to the embodiment of the present invention ends in the case in which termination is selected.

Figure 4:
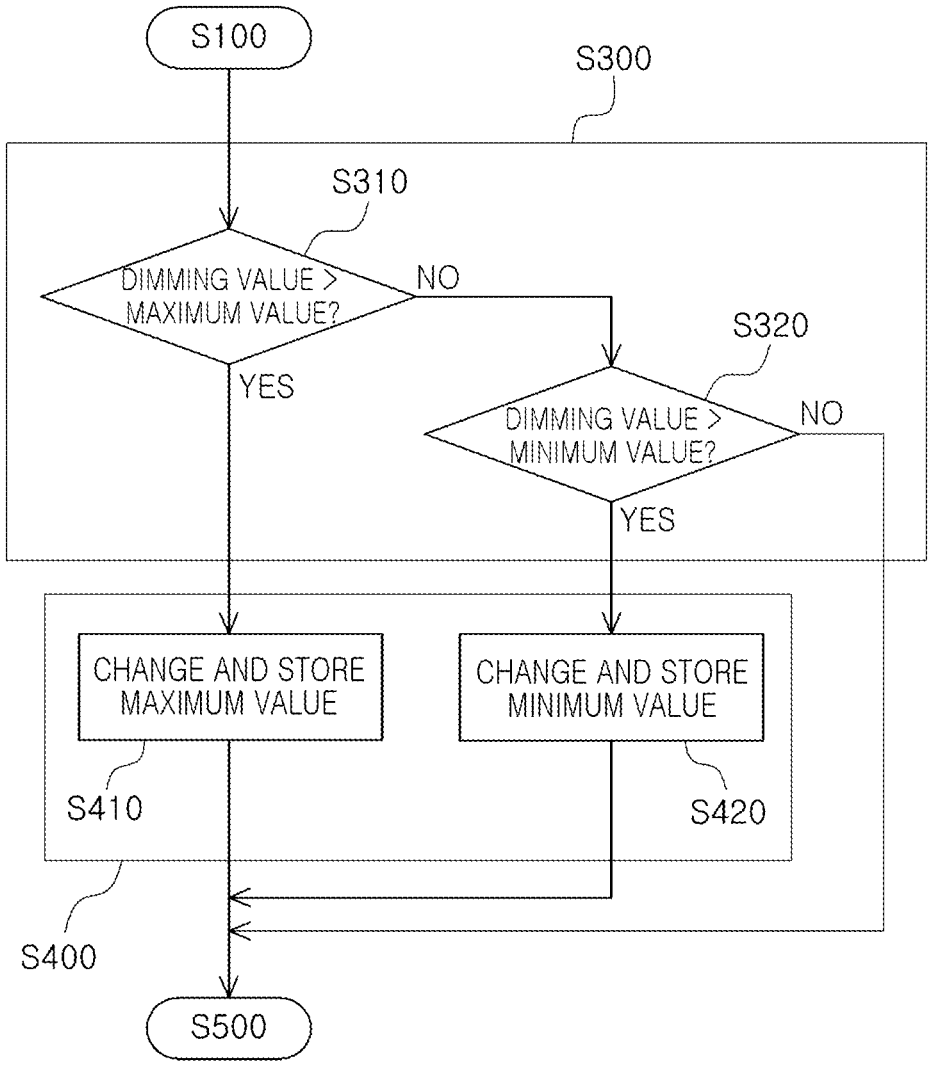
FIG. 4 is a flowchart showing a process of determining whether a digital dimming value is present within a dimming value range, changing the dimming value range, and storing the changed dimming value range according to the embodiment of the present invention.

FIG. 4 is a flowchart showing a process of determining whether a digital dimming value is present within a dimming value range and changing the dimming value range and storing the changed dimming value range according to the embodiment of the present invention.

Referring to FIG. 4, in the determining (S300), whether or not the digital dimming value Ddim is higher than the maximum value of dimming value range may be determined (S310), and when it is not higher than the maximum value of the dimming value range, whether or not the digital dimming value Ddim is lower than the minimum value of the dimming value range may be determined (S320).

Next, in the resetting of the dimming value range (S400), when the digital dimming value Ddim is higher than the maximum value of the dimming value range, the maximum value may be changed and the changed maximum value may be stored (S410).

In addition, in the resetting of the dimming value range (S400), when the digital dimming value Ddim is lower than the minimum value of the dimming value range, the minimum value may be changed and the changed minimum value may be stored (S420).

Figure 5:
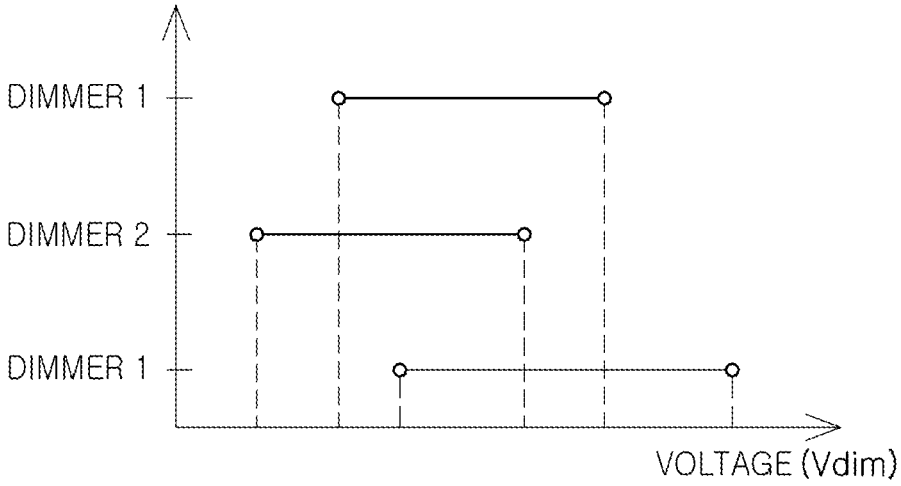
FIG. 5 is a diagram showing dimming voltage levels of dimmers the embodiment of the present invention.

FIG. 5 is a diagram showing dimming voltage levels of dimmers according to the embodiment of the present invention.

Referring to FIG. 5, it is appreciated that the dimming voltage levels of the respective dimmers (for example, a dimmer 1, a dimmer 2, and a dimmer 3) may be different.

As describe above, even in the case in which various dimmers provide different dimming voltage levels, digital dimming values and dimming control values suitable for respective dimmers may be reset according to the embodiment of the present invention, such that various types of dimmer may be adopted regardless of whether or not they are compatible with an LED lighting system.

Figure 6:
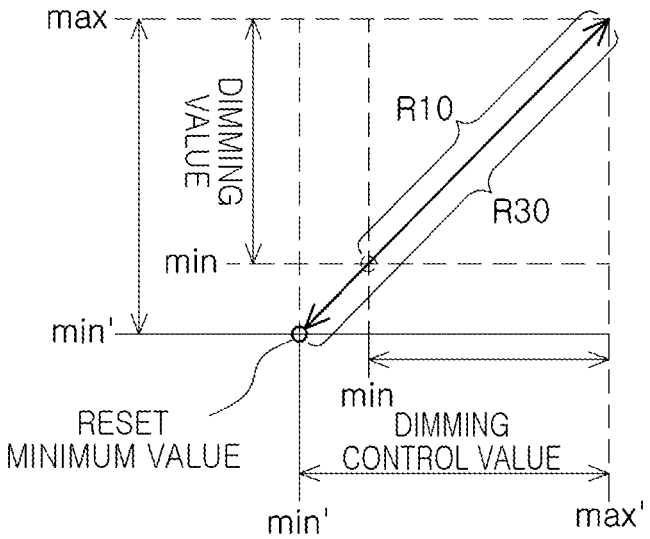
FIG. 6 is a diagram describing resetting a minimum value of the dimming value range according to the embodiment of the present invention.

FIG. 6 is a diagram describing resetting a minimum value of the dimming value range according to the embodiment of the present invention.

Referring to FIG. 6, it may be appreciated that the range of digital dimming values and the range of dimming control values may be adjusted by resetting a new minimum value min' through a process of changing the minimum value min of each of the digital dimming values and the dimming control values, as described above.

Figure 7:
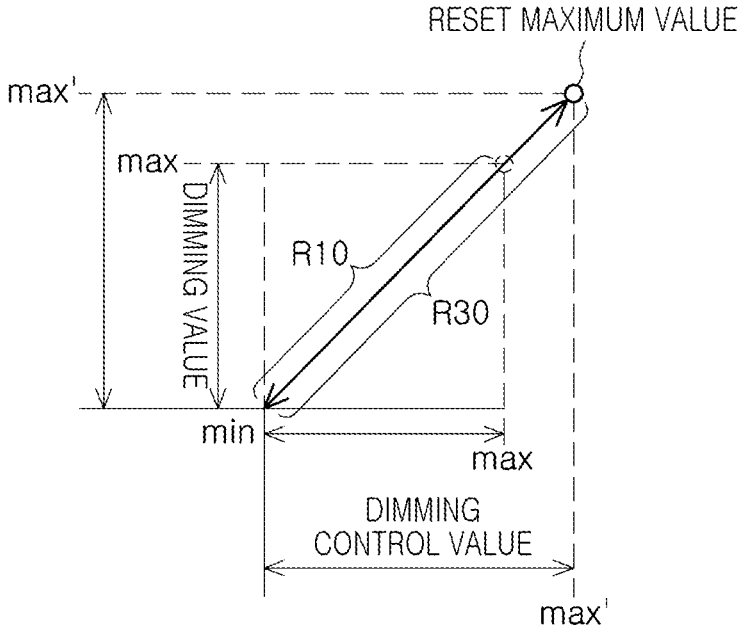
FIG. 7 is a diagram describing a maximum value of the dimming value range according to the embodiment of the present invention.

FIG. 7 is a diagram describing a maximum value of the dimming value range according to the embodiment of the present invention.

Referring to FIG. 7, it may be appreciated that the range of digital dimming values and the range of the dimming control values may be adjusted by resetting a new maximum value max' through a process of changing the maximum value max of each of the digital dimming values and the dimming control values, as described above.

As set forth above, according to the embodiments of the present invention, a dimming value range can be reset so as to correspond to various dimmers having different characteristics and the compatibility of the dimmers are thus increased, such that the usage, changes and replacement of the dimmers can be facilitated.

While the present invention has been shown and described in connection with the embodiments, it will be apparent to those skilled in the art that modifications and variations can be made without departing from the spirit and scope of the invention as defined by the appended claims.

What is claimed is:

1. A dimming control apparatus, comprising:

a voltage converting unit converting a dimming signal from a dimmer into dimming voltage;

an analog-to-digital (A/D) converting unit converting the dimming voltage into a digital dimming value;

a dimming setting unit determining whether or not the digital dimming value is included in a preset dimming value range, and when the digital dimming value is not included in the preset dimming value range, resetting the dimming value range so as to allow the digital dimming value to be included in the reset dimming value range;

a memory unit storing a dimming control value corresponding to the digital dimming value; and a dimming control unit generating a dimming control signal based on the dimming control value corresponding to the digital dimming value from the A/D converting unit.

2. The dimming control apparatus of claim 1, wherein the dimming setting unit determines whether or not the digital dimming value is higher than a maximum value of the dimming value range, and when the digital dimming value is higher than the maximum value of the dimming value range, changes the maximum value and stores the changed maximum value.

3. The dimming control apparatus of claim 2, wherein the dimming setting unit determines whether or not the digital dimming value is lower than a minimum value of the dimming value range, and when the digital dimming value is lower than the minimum value of the dimming value range, changes the minimum value and stores the changed minimum value.

4. A lighting system driving apparatus, comprising:

a voltage converting unit converting a dimming signal from a dimmer into dimming voltage;

an analog-to-digital (A/D) converting unit converting the dimming voltage into a digital dimming value;

a dimming setting unit determining whether or not the digital dimming value is included in a preset dimming value range, and when the digital dimming value is not included in the preset dimming value range, resetting the dimming value range so as to allow the digital dimming value to be included in the reset dimming value range;

a memory unit storing a dimming control value corresponding to the digital dimming value;

a dimming control unit generating a dimming control signal based on the dimming control value corresponding to the digital dimming value from the A/D converting unit; and a driving unit generating a lighting system driving signal according to the dimming control signal.

5. The lighting system driving apparatus of claim 4, wherein the dimming setting unit determines whether or not the digital dimming value is higher than a maximum value of the dimming value range, and when the digital dimming value is higher than the maximum value of the dimming value range, changes the maximum value and stores the changed maximum value.

6. The lighting system driving apparatus of claim 5, wherein the dimming setting unit determines whether or not the digital dimming value is lower than a minimum value of the dimming value range, and when the digital dimming value is lower than the minimum value of the dimming value range, changes the minimum value and stores the changed minimum value.

7. The lighting system driving apparatus of claim 4, wherein the driving unit generates the lighting system driving signal using a pulse width modulation scheme in order to drive an LED light emitting unit according to the dimming control signal.

8. A dimming control method performed in a dimming control apparatus, the dimming control method comprising:

converting a dimming signal from a dimmer into dimming voltage;

converting the dimming voltage into a digital dimming value;

determining whether or not the digital dimming value is included in a preset dimming value range;

resetting the dimming value range so as to allow the digital dimming value to be included in the reset dimming value range when the digital dimming value is not included in the preset dimming value range, and storing a dimming control value corresponding to the digital dimming value; and generating a dimming control signal based on the dimming control value corresponding to the digital dimming value.

9. The dimming control method of claim 8, wherein in the determining of whether or not the digital dimming value is included in the preset dimming value range, it is determined whether or not the digital dimming value is higher than a maximum value of the dimming value range, and when the digital dimming value is not higher than the maximum value of the dimming value range, it is determined whether or not the digital dimming value is lower than a minimum value of the dimming value range.

10. The dimming control method of claim 9, wherein in the resetting of the dimming value range, when the digital dimming value is higher than the maximum value of the dimming value range, the maximum value is changed and stored.

11. The dimming control method of claim 9, wherein in the resetting of the dimming value range, when the digital dimming value is lower than the minimum value of the dimming value range, the minimum value is changed and stored.

* * * * *